United States Patent [19]

Voges

[11] Patent Number: 4,471,573

[45] Date of Patent: Sep. 18, 1984

[54] PACKAGE FOR PLANT POTS

[76] Inventor: Albert J. Voges, Leidsestraat 83, 2182 DJ Hillegom, Netherlands

[21] Appl. No.: 414,806

[22] Filed: Sep. 3, 1982

[51] Int. Cl.[3] ..... A01G 9/02

[52] U.S. Cl. ..... 47/84; 220/23.83; 229/22; 229/87 P; 206/423

[58] Field of Search ..... 47/39, 66, 73–78, 47/84–87; 229/87 P, 22, 2.5 R, 22, 40; 206/423, 463; 220/DIG. 13, 4 C, 6, 23.83, 23.86

[56] References Cited

U.S. PATENT DOCUMENTS

| | | | |
|---|---|---|---|
| 2,483,464 | 10/1949 | Johnson | 229/22 |
| 3,322,267 | 5/1967 | Weiss | 229/2.5 |
| 3,587,838 | 6/1971 | Mirjata | 229/2.5 |
| 3,912,079 | 10/1975 | Serchow | 206/463 |
| 3,992,810 | 11/1976 | Kimball | 47/84 X |

FOREIGN PATENT DOCUMENTS

| | | | |
|---|---|---|---|
| 939512 | 1/1974 | Canada | 47/84 |

*Primary Examiner*—James R. Feyrer
*Attorney, Agent, or Firm*—Kane, Dalsimer, Kane, Sullivan and Kurucz

[57] ABSTRACT

A clean package for plant pots filled with soil and plants, bulbs or tubers to be used for display of the vegetable item in shops is provided comprising three adjacent components to be coupled at the outer ends to form an article of prismatic shape, each component being shaped to envelop partially one or two plant pots of either square or round shape, so that the coupled assembly of the three components provides accomodation for one or three plants pots, whereas optional seam closures and/or stiffening grooves are incorporated.

13 Claims, 15 Drawing Figures

PACKAGE FOR PLANT POTS

BACKGROUND OF THE INVENTION

The invention relates to a packing device to be used in supermarkets or other shops for display of plants, bulbs, tubers or other vegetable items being rooted in a soil filled pot.

There is a growing tendency among supermarkets and warehouses to diverge the assortment of articles available for the clients, so that one is not surprised anymore to encounter in one single shop articles ranging from furniture to food and live products. It appeared, however, that the sale of live plants presents problems. The plants being placed in their pots on the shelves of the shop tend on one hand to dry out and loose their good condition if not sold quickly, and on the other hand to contaminate the surroundings by soil spoilt from the pots. Moreover, the transport and storage of these plants provide some inconveniences.

Therefore, the need exists for a clean package for plant pots, in which the plants are readily packed and displayed in the shops.

SUMMARY OF THE INVENTION

It is an object of the present invention to provide a package for plant pots filled with soil and plants, bulbs or tubers which secures that the vegetable item to be sold may be transported, displayed, and purchased under conditions which allow the plants to survive and which prevent contamination of the surroundings.

More specifically it is an object of the present invention to provide a package which prevents any spoilt soil to leak out from the package.

Further it is an object of the present invention to provide a package which secures an appropriate humidity level of the soil of the plants to be maintained for a longer period.

Another object of the invention is to provide a package for plant pots which could readily be packed for transport and storage purposes without mechanical damage to the plants.

Further it is an object of the invention to provide a package which allows the vegetable product offered for sale to be readily inspected by a potential buyer.

The above-mentioned objects are obtained according to the invention by a package which consists of an assembly of three blocks of triangular shape, being hingedly joined to each other along the upright ribs bounding the long side face of one of the blocks. The assembly of three blocks in line may be fitted into an article of prismatic shape by folding along the hinged joints and be fastened with the aid of coupling means provided at the free ends of the assembly. In order to have the short side faces of said three blocks lying against each other the blocks have apex angles of 120°. In these short side faces recesses are present which are complementary to a part of the contour of a plant pot and which thus together form spaces for accomodation of plant pots. These recesses may be designed for accomodating plant pots of either round or square shape. When it is intended to display three relatively small plant pots with plants in one package, each block is shaped to envelop the two halves of two respective plant pots so that the total assembly may accomodate the three pots. When it is an object to display one somewhat larger plant pot in one package, each block is shaped to envelop one third of the outer surface of this plant pot. For low growing plants which cover the soil surface the recesses in the short side faces of the blocks have shapes which envelop the bottoms and the side walls of the plant pots, whereas the top face of the space formed by the recesses is left open. For plants with a narrow stem these recesses have such a shape that the space formed additionally envelops the top face of the plant pot, thus covering the soil, leaving free, however, a central opening through which the plant may pop out.

Optionally seam closures, for example of the tongue and groove type, may be provided near the lower end of the short side face of said blocks, so that when the package is closed, any spoilt soil is prevented to leak from the package. For this purpose the two short side faces of each block carry a tongue and groove respectively, which fit to the groove and tongue respectively of the adjacent blocks when the assembly is coupled.

Furthermore, each component may comprise above the hollow triangular block a vertical wall extending upright from the long side face of said block, and having its base coincident with the long side of the triangular top face of the block. The three vertical walls of the total assembly are hingedly joined together in a way similar to that of the blocks. By the three walls a shelter for the plants is provided above the plant pots so that packages with plant pots may be packed without any risk of damage of the leaves of the plants.

If desired, stiffening means in the form of stiffening grooves may be incorporated near the upper end of the vertical walls, so that even when a relatively flexible material is used to manufacture the package, a rigid structure of the prism shaped package is secured offering further protection against mechanical damage of the plants.

The package according to the invention may be formed in one part from any material which is readily available. In order to make the plant readily inspectable when it is in the package, said package preferably is manufactured from a transparent plastic material.

BRIEF DESCRIPTION OF DRAWINGS

FIG. 1 is a top-view of the open package.

FIG. 2 is a top-view of the package being coupled.

FIG. 3 is a side-view of the coupled package.

FIG. 4 is a top-view of the open package, whereas FIGS. 5 and 6 show a top-view and side-view, respectively, of the closed assembly.

FIG. 7 is a top-view of the open package, whereas FIGS. 8 and 9 show a top-view and a side-view, respectively, of the coupled assembly.

FIG. 10 is a top-view, whereas FIGS. 11 and 12 show a top-view and a side-view, respectively, of the coupled assembly.

FIG. 13 is a top-view of the open package, whereas FIGS. 14 and 15 show a top-view and a side-view, respectively, of the closed package.

DETAILED DESCRIPTION OF THE INVENTION

Figure 1:
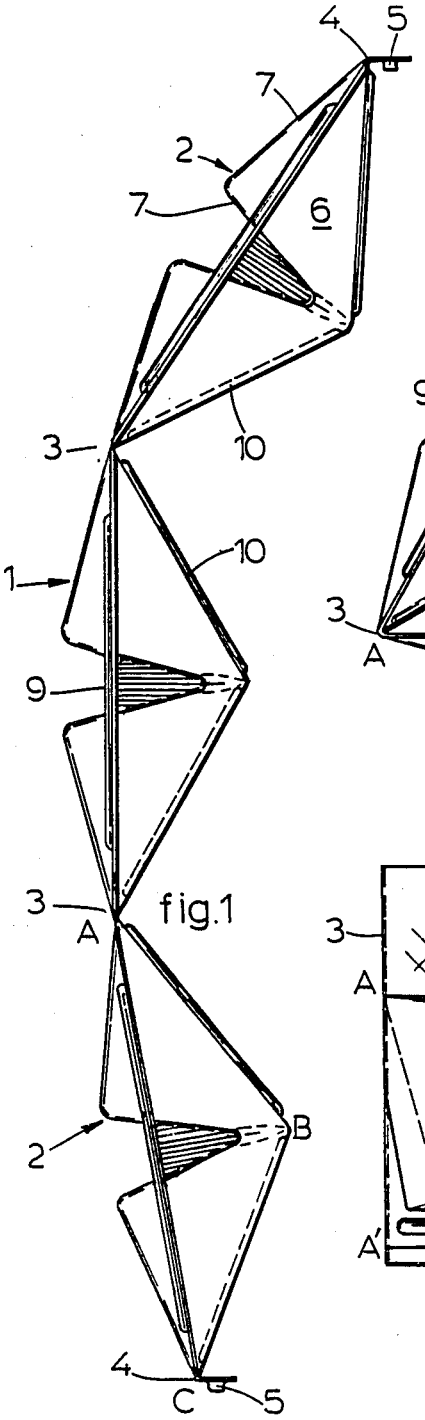
FIGS. 1–3 show a first embodiment of a package according to the invention for accomodating three square plant pots.
Figure 2:
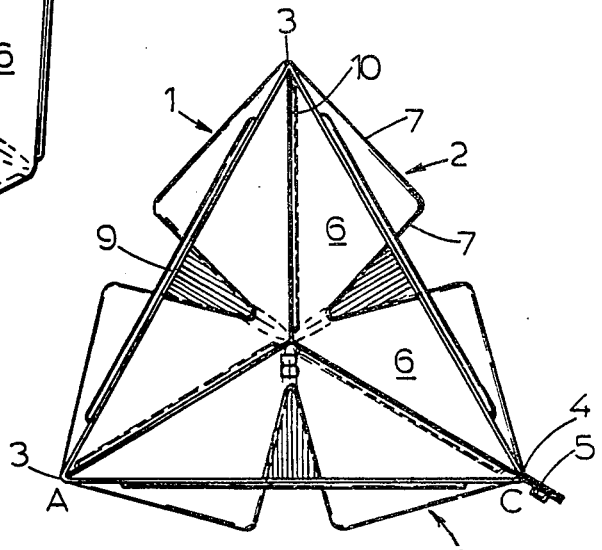
Figure 3:
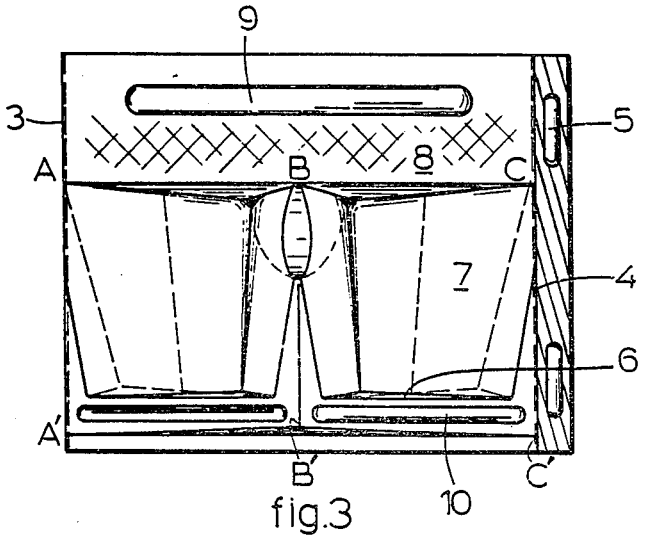

In FIGS. 1–3 a package for three square plant pots is shown. FIG. 1 shows a top-view of the uncoupled assembly of three components 1, 2, the first component 1 being hingedly joined along the ribs 3 to the second and third component 2. Each component 1, 2 comprises a hollow triangular block ABCA'B'C' as indicated in the figure for one of the side components 2. These triangular blocks have an apex angle $\beta$ of 120°, so that the short side faces of the three blocks will lie against each other as shown in FIG. 2 when the package is closed by folding along the ribs 3. Along the ribs 4 at the free ends of the second and third components 2 coupling means 5 are present in order to hold the assembly of the three components in closed position. Conveniently, the coupling means consists of one or more tongues at the one end which may be snapped into the same number of corresponding grooves at the other end. The long side face ACC'A' is open. In the short side faces ABB'A', BCC'B' of the triangular blocks recesses are present for accomodation of the square plant pots. For this purpose the recess in each short side face of the block is inwardly directed and comprises a lower horizontal triangular plane 6 as well as substantially vertical planes 7 emerging from the shorter sides of the triangular plane 6. In this way each recess is complementary to one half of a plant pot so that when the package is closed the recesses in corresponding short side surfaces of the blocks form together a space for accomodation of the plant pot. The top face of this space is left open so that the embodiment according to the FIGS. 1–3 may in particular be used for low growing plants which cover the soil surface.

From the line AC of the triangular top face of each block vertical walls 8 extend. The first of these vertical walls 8 which is above the block of the first component 1, is hingedly joined along the same ribs 3, to the second and third vertical walls 8. Near the upper end of these vertical walls 8 a stiffening means in the form of a stiffening groove 9 is present.

Beneath the recesses formed by the triangular planes 6 and vertical planes 7 seam closures 10 are present at the lower end of the short side faces of the triangular blocks. Conveniently these seam closures 10 consist of a tongue and a groove, respectively, on the adjacent short side surfaces of two blocks so that the tongue fits in the groove when the package is closed and closure of the seams between the three triangular blocks is obtained. A total of three tongues and three grooves provides the three seam closures of the package.

Figure 4:
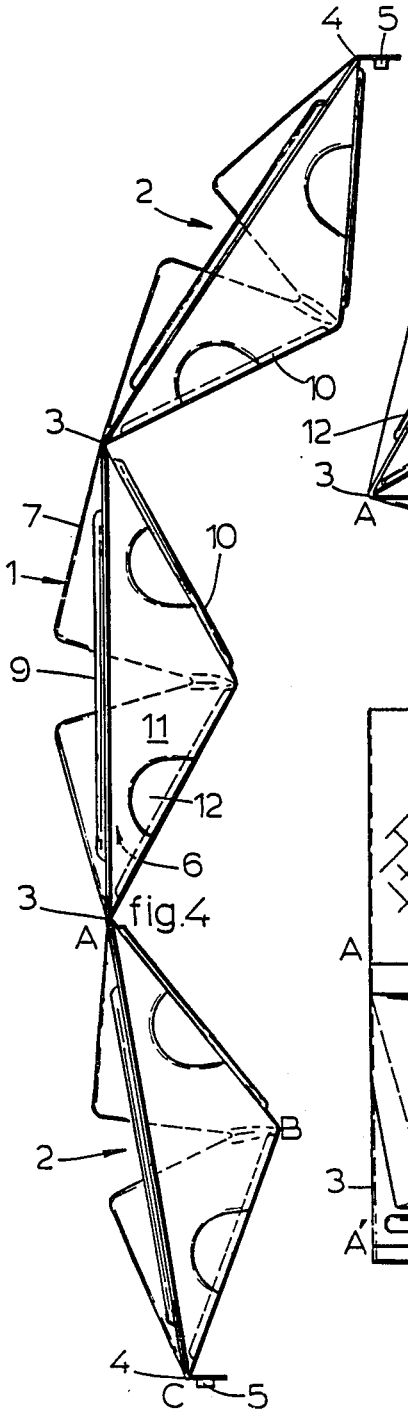
FIGS. 4–6 show a second embodiment of the invention, also designed for three square plant pots, but with additional covering of the soil surface.
Figure 5:
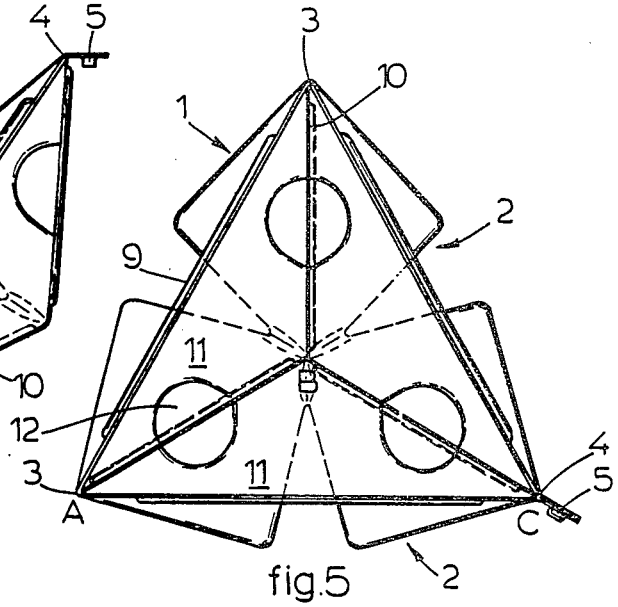
Figure 6:
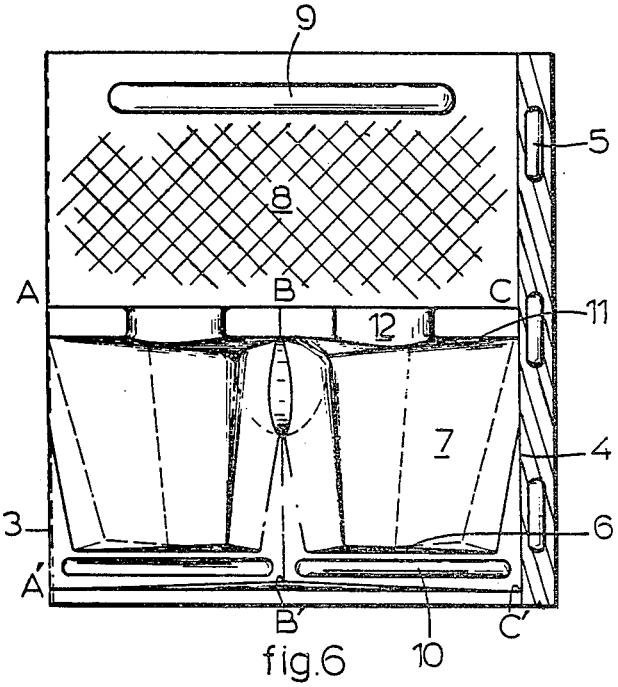

In FIGS. 4–6 a second embodiment of the package according to the invention is shown, which is also designed for three square plant pots. All elements of the embodiment according to the FIGS. 1–3 are also present in the embodiment according to FIGS. 4–6, but in the latter additionally soil surface covering is provided for by means of differently shaped recesses in each of the short side faces of the triangular blocks. For that the spaces formed by the lower horizontal triangular planes 6 and substantially vertical planes 7 are bounded at the top by an upper horizontal triangular plane 11 in which a half-circular opening 12 is left free at the middle of the longest side. When the package is closed by means of the coupling means 5 spaces are formed by each pair of recesses, which spaces may envelop square plant pots including the soil surface, but leaving free a round opening through which the stem of a plant may pop out.

Figure 7:
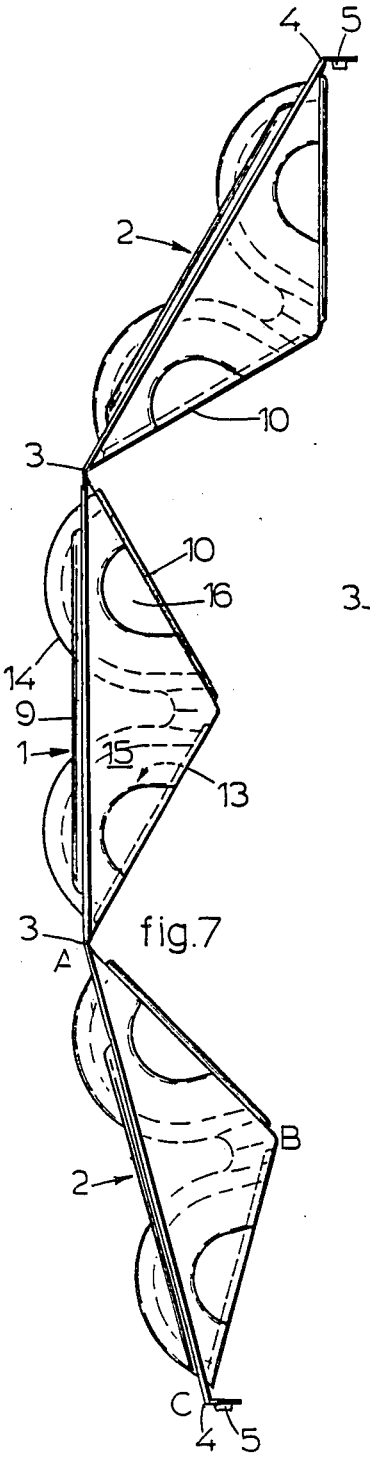
FIGS. 7–9 show a third embodiment according to the invention for accomodating three round plant pots.
Figure 8:
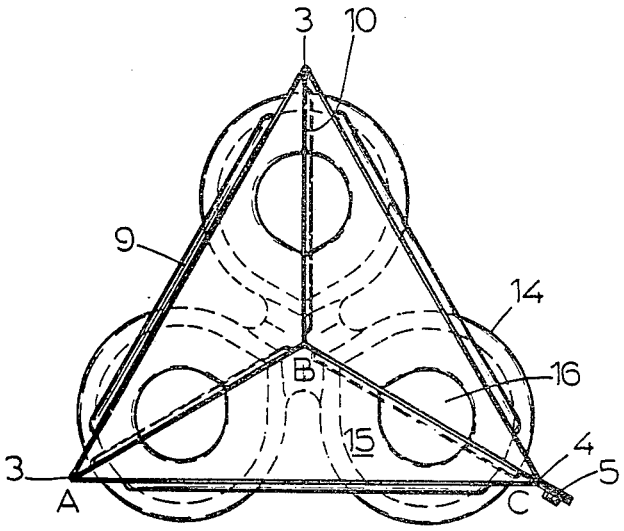
Figure 9:
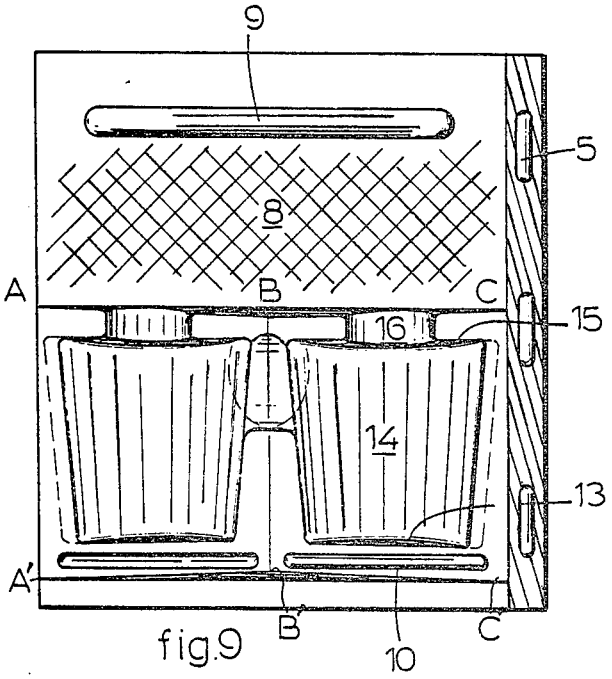

An embodiment of the package of the invention according to FIGS. 7–9 which is to be used for three round plant pots also consists of a first component 1, a second and third component 2 and coupling means 5. Each component is very similar to the components described before, except that the recesses in the shorter side faces of the triangular block have in this case a shape complementary to one half of a round plant pot. Therefore, in each shorter side face of the triangular block a recess is provided in the form of a lower horizontal half-circular plane 13, a half-cylindrical surface 14 emerging from the circumference of the half-circular plane 12, as well as an upper half-circular plane 15 above the lower half-circular plane 13 leaving free a half-circular opening 16 of shorter radius. When the package is closed and the recesses of each component are aligned with the corresponding recesses of the other components, spaces are provided for accurate envelopment of three round plant pots but leaving free round openings located centrally at the top through which the plant may pop out from the envelopment.

Figure 10:
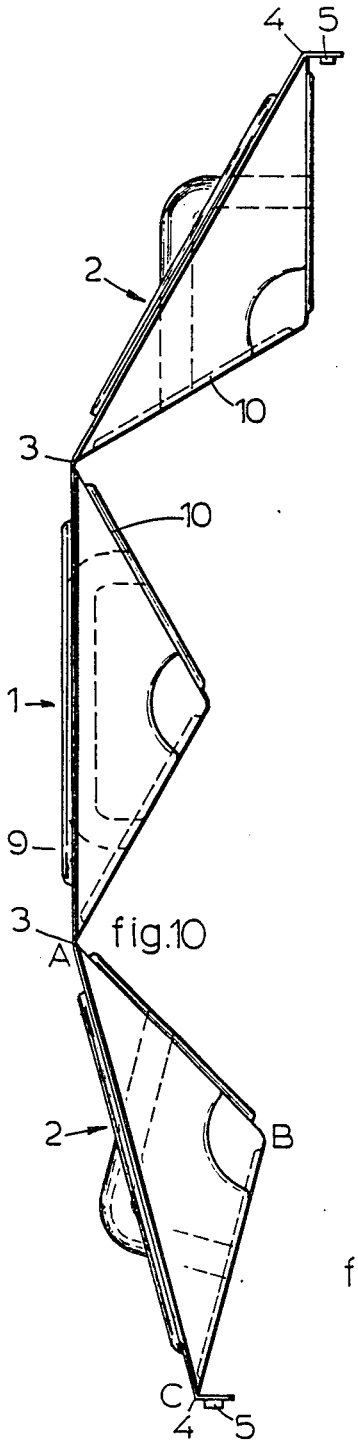
FIGS. 10–12 show a fourth embodiment of the invention for accomodating a single square plant pot.
Figure 11:
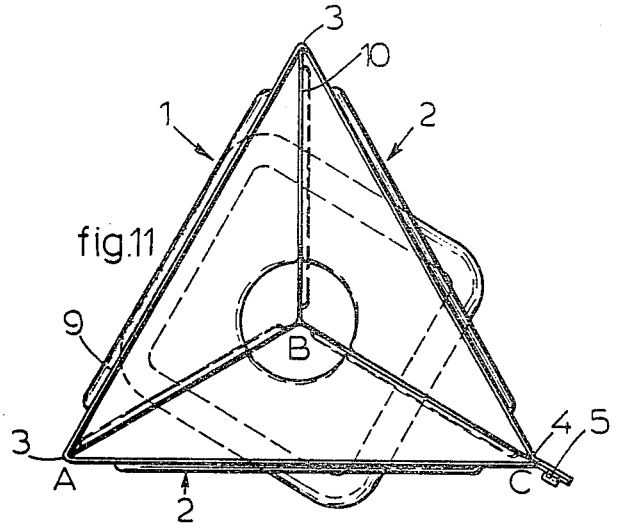
Figure 12:
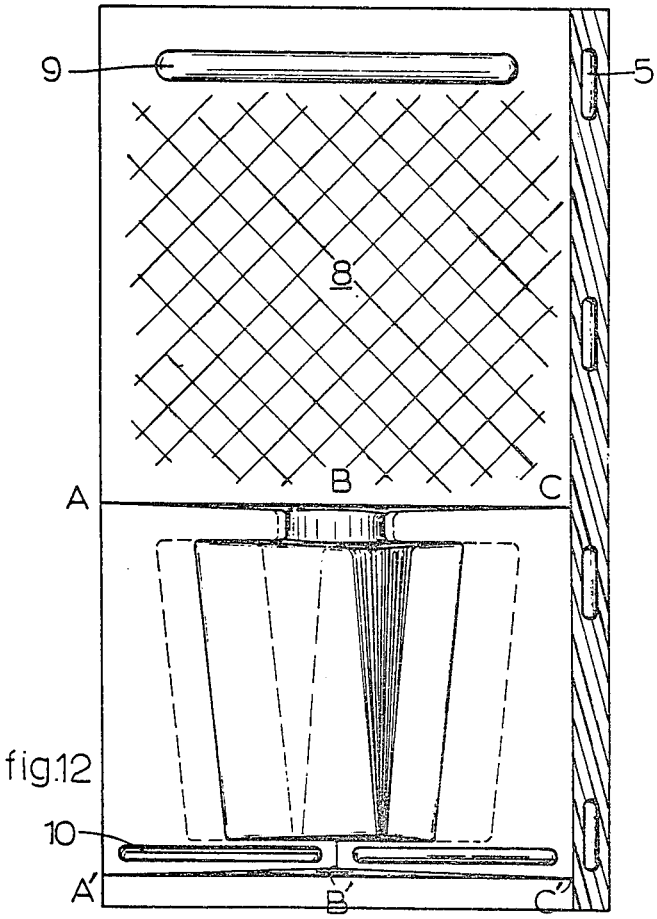

A further embodiment of the invention is shown in FIGS. 10–12, wherein a first component 1, a second and third component 2 as well as coupling means 5 can be seen. As before each component comprises again a triangular block ABCA'B'C' from which a rectangular vertical wall 8 emerges. Further seam closures 10 as well as stiffening grooves 9 are also present, in the same manner as described above. The package is designed to accomodate a single square plant pot and therefore the recesses in the short side faces of the triangular blocks are shaped to envelop each one third of the outer surface of one square plant pot, as is seen in FIG. 11. As illustrated, the recess in the pair of short side faces of the triangular block of component 1 is shaped to envelop a first side wall of a square plant pot as well as minor parts of their two adjacent side walls. The second and third component are each shaped to provide accomodation of the major part of one of the said adjacent side walls as well as half of the fourth side wall of the plant pot. Furthermore, in the illustrated embodiment the combined recesses provide a space having closed top surface except a circular opening centrally above said space. It is of course to be understood that the illustrated embodiment can easily be modified by rotation of the square space formed by the combined recesses around the central axis.

Figure 13:
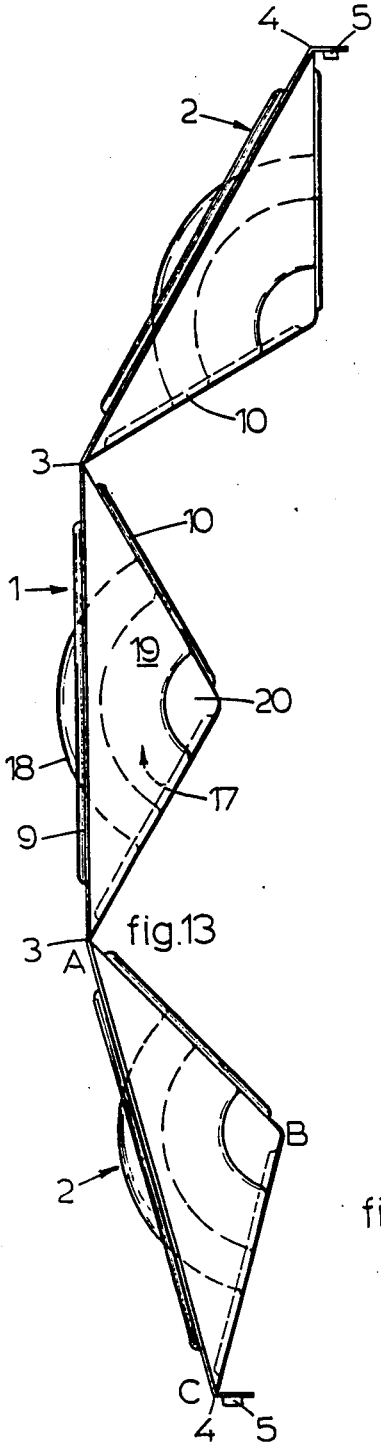
FIGS. 13–15 show a fifth embodiment according to the invention for accomodating a single round plant pot.
Figure 14:
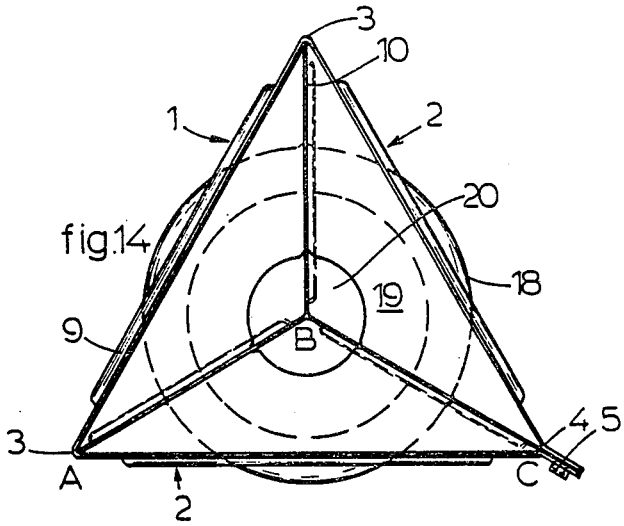
Figure 15:
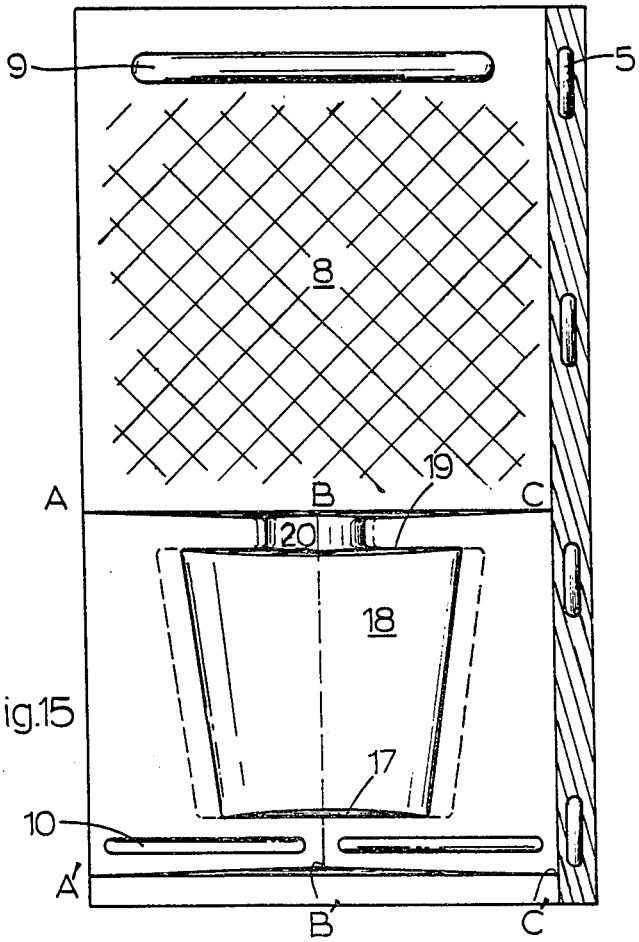

Still another embodiment of the package according to the invention is shown in FIGS. 13–15, wherein the package may accomodate a single round plant pot. This embodiment comprises a first component 1, second and third components 2, couping means 5, rectangular vertical walls 8, stiffening grooves 9, seam closures 10, as discussed before, as well as hollow triangular blocks. The recess in the pair of short side faces of each block is shaped of complementary to $\frac{1}{3}$ of a round plant pot, so that the three components together may accomodate a single plant pot, when the package is closed. Each recess comprises a lower 120° sector plane 17 as well as a substantially vertical cylindrical surface 18 emerging from the circumference of the sector plane 19. In the embodiment shown each recess further is shaped with an upper 120° sector plane 19 of slightly larger radius than the lower sector plane 17, thus providing a cover for the soil filled plant pot. As before, a circular opening 20 is left free in the combined upper 120° sector planes 19 centrally above the space obtained by coupling of the free ends of the assembly of the three components.

As is apparent from above the package of the invention can be used for conveniently packing and displaying live plants. Because of close envelopment of the plant pots by the recesses in the short side faces of the triangular blocks any drying out or spoiling of the soil contained in the pot(s) of either round or square shape is prevented. Furthermore, the vertical walls protruding from the triangular blocks provide a shelter for the leaves of the plants protected against damage and easily to be viewed.

What is claimed is:

1. A package for plant pots comprising three components which each comprise a hollow triangular block having an apex angle of about 120° and being open at its long side face; the first of said components being hingedly joined along upright ribs bounding the long side face to the corresponding ribs of the second and third components; said second and third components being provided with coupling means at the opposite upright ribs, so that when being coupled the short side faces of said three blocks lie against each other; and in which said short side faces define recesses which together form a plurality of spaces to accommodate a plurality of plant pots.

2. The package according to claim 1, wherein each short side face is provided with a recess complementary to one half of a plant pot, so that the three components together may accomodate three plant pots.

3. The package according to claim 2, wherein said recesses are complementary to round plant pots.

4. The package according to claim 3, wherein said recesses have such a shape that the spaces formed may closely envelop the bottoms and the sides of the plant pots.

5. The package according to claim 3, wherein said recesses have such a shape that the spaces formed may closely envelop the bottoms and the sides as well as the top faces of the plant pots leaving free an opening at the centre of said top face.

6. The package according to claim 2, wherein said recesses are complementary to square plant pots.

7. The package according to claim 6, wherein said recesses have such a shape that the spaces formed may closely envelop the bottoms and the sides of the plant pots.

8. The package according to claim 6, wherein said recesses have such a shape that the spaces formed may closely envelop the bottoms and the sides as well as the top faces of the plant pots leaving free an opening at the centre of said top face.

9. The package according to claim 4, 5, 7 or 8, further comprising seam closures near the lower end of the short side faces of said blocks.

10. The package according to claim 9, wherein each component further comprises a vertical wall extending upright from the long side face of said block.

11. The package according to claim 10, further comprising stiffening means near the upper ends of said vertical walls.

12. The package according to claim 11, being manufactured from a transparent plastic material.

13. A package for plant pots comprising three components which each comprise a hollow triangular block having a apex angle of about 120° and being open at its long side face; the first of said components being hingedly joined along the upright ribs bounding the long side face to the corresponding ribs of the second and third components; said second and third components being provided with coupling means at the opposite upright ribs, so that when being coupled the short side faces of said three blocks lie against each other; in which short side faces recesses are provided with together form at least one space for accommodation of a plant pot, wherein said recess is formed to closely envelop the bottom and the side, as well as the top face of the plant pot leaving free an opening at the center of said top face, said package further comprising seam closures near the lower end of the short side faces of said blocks, a vertical wall extending upright from the long side face of said block, a stiffening means near the upper ends of said vertical walls and said package being manufactured at least in part from a transparent plastic material.

* * * * *